United States Patent [19]
Haslett
[11] 4,231,423
[45] Nov. 4, 1980

[54] HEAT PIPE PANEL AND METHOD OF FABRICATION

[75] Inventor: Robert A. Haslett, Dix Hills, N.Y.
[73] Assignee: Grumman Aerospace Corporation, Bethpage, N.Y.

[21] Appl. No.: 859,002
[22] Filed: Dec. 9, 1977
[51] Int. Cl.[3] ..... F28D 15/00
[52] U.S. Cl. ..... 165/105; 165/133; 165/DIG. 12; 29/157.3 R; 29/157.3 V
[58] Field of Search ..... 165/105, 133, DIG. 12; 29/157.3 R, 157.3 V

[56] References Cited

U.S. PATENT DOCUMENTS

| | | | |
|---|---|---|---|
| 3,450,195 | 6/1969 | Schnacbe | 165/105 X |
| 3,788,388 | 1/1974 | Barbmann | 165/105 X |
| 3,933,198 | 1/1976 | Hara et al. | 165/105 X |
| 4,079,702 | 3/1978 | Furubawa et al. | 165/133 X |
| 4,118,756 | 10/1978 | Nelson et al. | 165/105 X |

*Primary Examiner*—Albert W. Davis
*Attorney, Agent, or Firm*—Bruce B. Brunda; Richard G. Geib

[57] ABSTRACT

A method for making a heat pipe panel comprising the steps of forming parallel furrows in a sheet metal plate, covering the sheet metal plate with another plate, bonding the plate together around the edges and between the furrows, to form parallel cavities between the plates, charging the cavities with working fluid and sealing the cavities to form individual heat pipes in the panel. The furrows may be filled with wicking material, and capillary grooves may be cut in the furrows before bonding the plates together. The cover plate also may have furrows formed therein. A header furrow may be provided for the fluid charging operations.

4 Claims, 12 Drawing Figures

HEAT PIPE PANEL AND METHOD OF FABRICATION

BACKGROUND

This invention relates to heat exchangers and has particular reference to heat-pipe panels for heat exchangers and a method for making them.

A heat-pipe is a totally enclosed, simple, mechanically static device which can transport large quantities of heat over long distances. Basically the heat pipe comprises a pipe-like sealed chamber charged with a vaporizable liquid of four regions: (a) The evaporator in which the working liquid is vaporized by the input heat (b) the vapor transport channel through which vapor flows from the evaporator to the condenser (c) the condenser where the vapor gives up heat and is condensed to liquid, and (d) the liquid transport section in which the liquid condensate flows back to the evaporator.

In some instances circumferential capillary grooves or wicking may be added in the evaporator and/or condenser section to improve liquid wetting or to aid condensate collection. Also, the liquid transport from condenser to evaporator may be aided by wicking which spans the entire length of the pipe from the condensor end to the evaporator end, by capillary grooves or by actually tilting the heat pipe.

Heat pipes are traditionally made as individual tubes and clustered together where additional capacity is required. For better heat transfer to a gaseous medium the tubes are generally provided with closely spaced fins. When a great quantity of heat pipes are required, as in the case of a regenerative heat exchanger between the exhaust flue of a power plant and the air intake to the power plant, the tube-and-fin heat pipe arrangement becomes economically unsuitable.

The present invention is a particularly attractive alternative to the tube-and-fin arrangement from both fabrication and operating viewpoints. In accordance with this invention a heat-pipe panel comprising a plurality of heat-pipes is fabricated by forming parallel furrows in sheet metal plates and then welding or bonding the plates together around each of the furrows to provide the separated chambers which are the individual heat pipes. The heat-pipes may be charged with fluid from a manifold furrow, after which the heat-pipe furrows are sealed by pinching the ends thereof.

If wicking is needed, it is placed in each furrow before assembly of the plates, eliminating the problems associated with drawing a wick into a tubular heat-pipe.

A heat exchanger is constructed by stacking a number of heat-pipe panels of this invention with a separator between the evaporator and condenser end, and the two fluid streams between which heat exchange is to take place being directed over the evaporator and condenser ends. The flat metal between the furrowed heat pipes absorbs or rejects heat and functions similarly to the fins on tubular heat-pipes. The separation of the panels, being significantly greater than the separation of fins on tubes will not become clogged by solid particles in the fluids stream as do the fins. The panels may be easily covered with a protective coating to resist corrosion and/or high temperature if desired. The type and thickness of the protective coating must be carefully selected as to not preclude effective operation of the panels. In conventional tube/fin units the application of a protective coating is not practical due to the close fin spacing.

These and other alternative embodiments will be explained in more detail in the descriptive material to follow.

BRIEF DESCRIPTION OF DRAWINGS

For a more complete description of the invention, reference may be had to the accompanying diagrams, in which.

DESCRIPTION OF PREFERRED EMBODIMENTS

Figure 1:
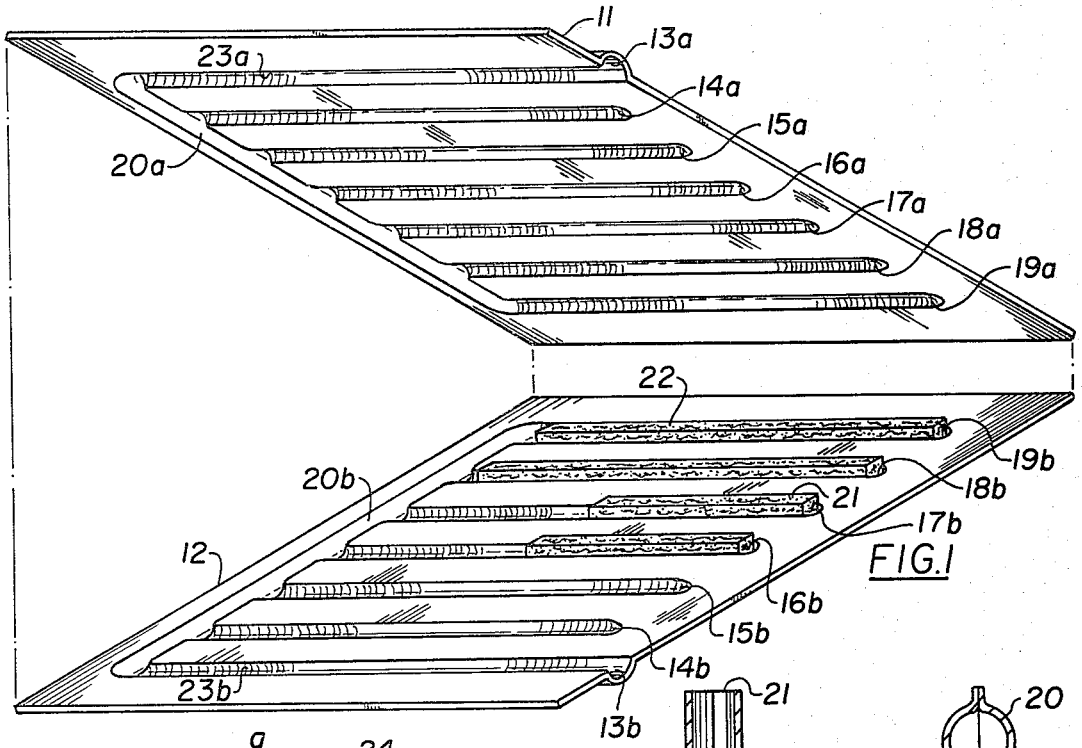
FIG. 1 is a pictorial view of a preferred embodiment of the heat pipe panel before assembly.

Referring now to FIG. 1 there are shown upper and lower plates 11, 12 respectively of the heat pipe panel 10. Formed into plate 11 are the transverse furrows 13*a* through 19*a* and formed into plate 12 are corresponding transverse furrows 13*b* through 19*b*. The furrows 13*a* and 13*b* extend from one edge of the respective plates 11 and 12 to the longitudinal furrows 20*a* and 20*b* respectively. The remaining furrows 14*a*–19*a* extend away from the furrow 20*a* but terminate within the confines of the plate 11. Similarly furrows 14*b*–19*b* are connected to furrow 20*b*, and terminate within the confines of plate 12.

The furrows 13*a*–19*a* and 13*b*–19*b* may be scored with grooves 23*a*, 23*b* respectively, which comprise capillary grooves in the completed heat pipe panel as will be explained later. The furrows in plate 12 may have full length wicking material 22 as shown in furrows 18*b* and 19*b*; they may have partial length wicking material 22 as shown in furrows 16*b* and 17*b*, or they may be completely empty as illustrated in furrows, 13*b*, 14*b* and 15*b* depending on proposed use for the panel. It is understood, of course, that in a completed panel each furrow usually will be similar to every other one as to the wicking included therein.

Figure 2:
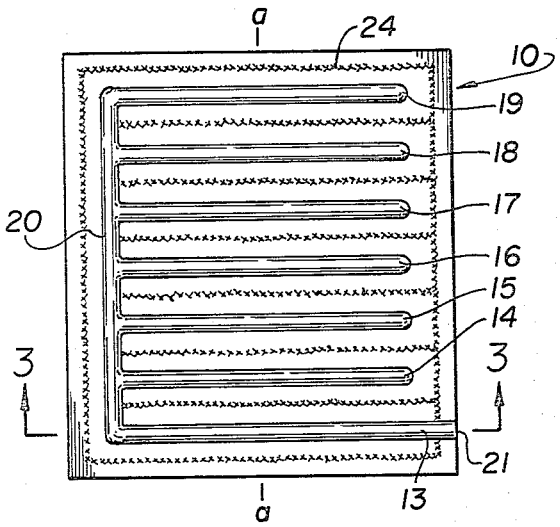
FIG. 2 is a top view of the assembled panel of FIG. 1.

The upper panel 11 is placed over the lower panel 12 and the plates are bonded together around the periphery of the panel and between each of the furrows as illustrated by the weld seam 24 in FIG. 2. The welded panel 10 then comprises a plurality of heat pipe chambers 13, 14, 15, 16, 17, 18, 19 connected to a header 20, each made up of the similarly numbered furrows in plates 11 and 12.

Figure 3:
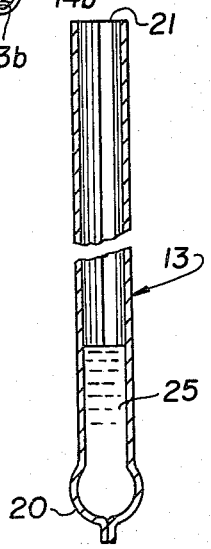
FIG. 3 is a section through 3—3 of FIG. 2 at one stage of assembly.

The heat pipes are charged with working fluid through the pipe 13 which terminates in the port 21 at the edge of the panel 10. The heat pipes 13–19 and header 20 are first evacuated through port 21 with apparatus not shown but well known in the art. With the panel 10 tilted about axis a-a (FIG. 2) so that header 20 is lower than port 21 (FIG. 3) and horizontal, (into the plane of the drawing) the working fluid 25 is introduced into the evacuated panel through port 21.

Figure 5:
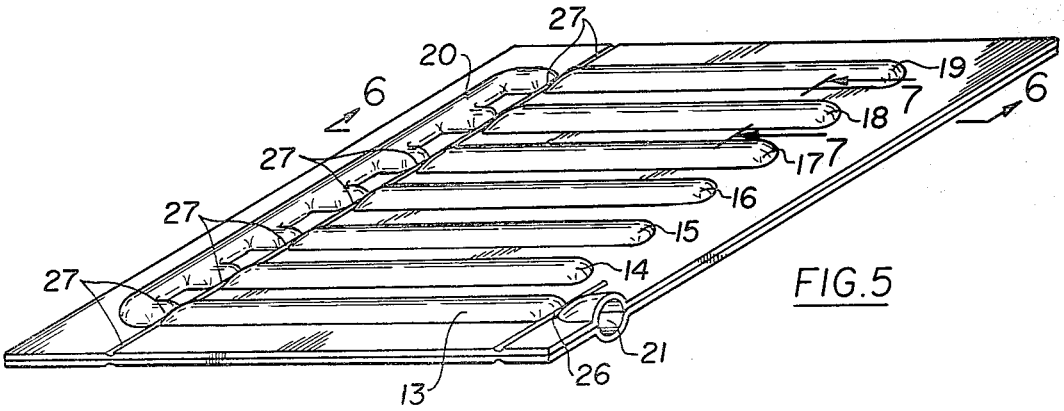
FIG. 5 is a pictorial view of a completed heat pipe panel.

The pipe 13 is then sealed closed by pinching 26 as shown in FIG. 5.

Figure 4:
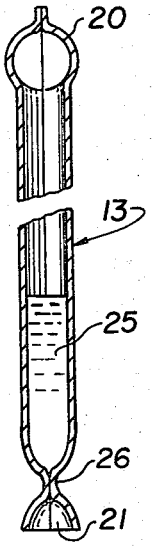
FIG. 4 is a modification of FIG. 3 at a further stage of assembly.

After tube 13 is sealed, the external apparatus is removed and the panel 10 is turned upside down, as shown in FIG. 4 i.e. about axis a-a so that header 20 is above port 21. The charging (working) fluid 25 in the header 20 is thus equally divided into the heat pipes 13 through 19. The ends of the heat pipes 13–19 are then sealed near the header 20 by pinches 27 as seen in FIG. 5. This may be done by any convenient method, such as passing the panel through a pair of opposed wheels. Thus, the heat pipes in the panel 10 are those sections of each of the chambers 13–19 which are located between the pinches 27 and the end of the furrow (or pinch 26 in the case of furrow 13).

Figure 6:
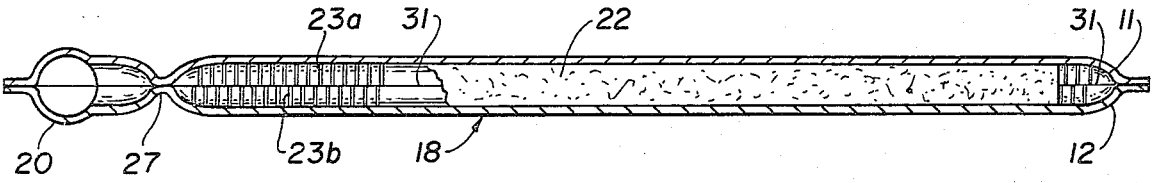
FIG. 6 is a sectional view through 6—6 of FIG. 5.
Figure 7:
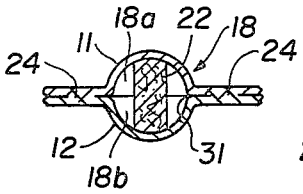
FIG. 7 is a sectional view through 7—7 of FIG. 5.

FIG. 6 shows a longitudinal section of heat pipe 18 taken through 6—6 of FIG. 5 and FIG. 7 shows a cross section of heat pipe 18 taken through 7—7 of FIG. 5. With reference first to FIG. 7, it will be seen that the furrows 18*a*, 18*b* which make up heat pipe 18 form cusps 31 where the plates 11 and 12 are joined. These cusps 31 are used to advantage to connect the peripheral capillary grooves 23*a* to 23*b* if they happen to be offset with respect to each other as seen in FIG. 6.

It will be recalled that the peripheral capillary grooves 23 are for the purpose of insuring that the working liquid 25 wets the entire inner surface of the heat pipes for ease of vaporization in the evaporator and, in the condenser for getting the condensate to the upper region of the liquid transport wicking 22 which is partly broken away to FIG. 6 to show the grooves 23 more clearly.

The choice of materials depends on service applications. Some examples are tabulated on next page.

| Temperature | Plate Material | Working Fluid |
|---|---|---|
| Very high, 1000°-2000°F. | Hastelloy; Inconel; Refractory | Sodium; Potassium; Lithium |
| Moderate, 200°-600°F. | Stainless Steel; Copper; Aluminum | Water |
| Room Temp. | Steel; Copper; Aluminum | Ammonium; Flourinated Hydrocarbons |
| Cryogenic | Steel; Copper; Aluminum | Hydrogen; Oxygen; Methane; Fluorinated Hydrocarbons |

Figure 8:
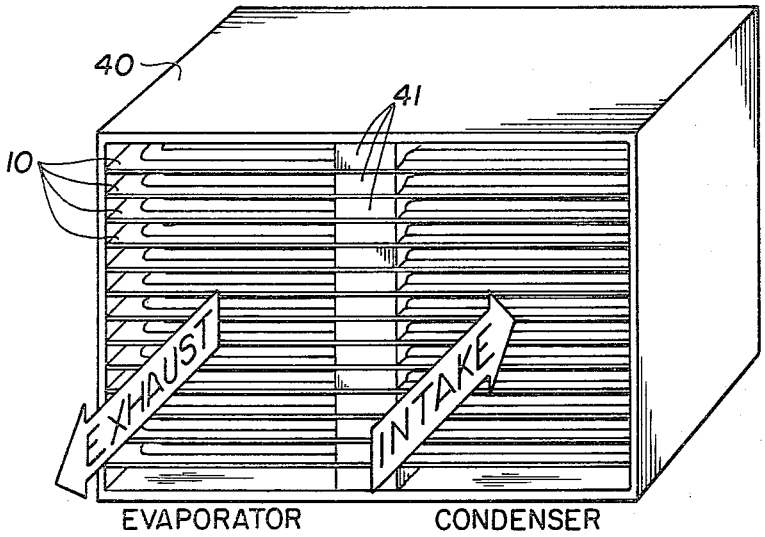
FIG. 8 illustrates a heat exchanger using stacked panels of FIG. 5.

FIG. 8 shows a regenerative heat exchanger for heat exchange between intake fluids and exhaust fluids in which a plurality of heat pipe panels 10, such as described in the preceding specifications are stacked in and enclosed by the envelope 40. Separators 41 between the panels 10, near the center of the heat pipes in the panels 10, isolate the exhaust air stream from the intake air stream. Where the intake air flows over the condenser end of the heat pipes and the exhaust air over the evaporator end of the heat pipes, the exhaust air heat is transported to warm up the intake air.

The intake will be cooled, as in some air conditioning installations, when the warm intake flows over the evaporator and the cooler exhaust over the condenser.

Figure 9:
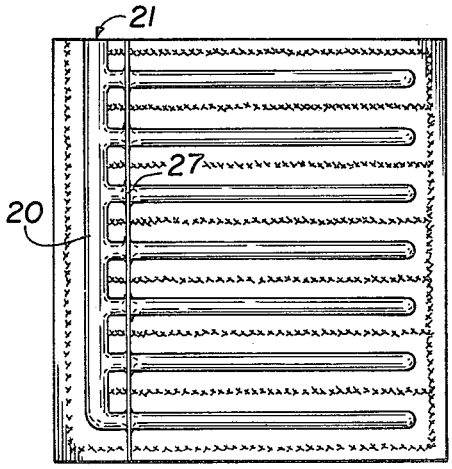
FIG. 9 is an alternative to the arrangement of FIG. 2.

It should be understood that many variations to the preferred embodiment herein described can be made without departing from the spirit of the invention. For example, the fill port 21 may be on an extension of the header chamber 20 (FIG. 9) instead of on an extended heat pipe 13.

In this instance pinching 27 of the tubes near the header is sufficient.

Figure 10:
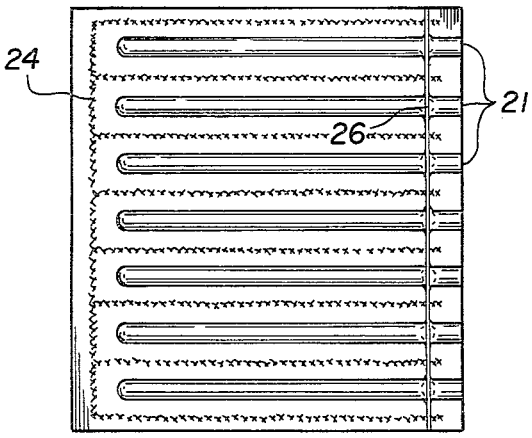
FIG. 10 is another modification of FIG. 2.

The heat pipes could be individually charged through separate ports such as port 21 at the end of each heat pipe, as seen in FIG. 10, and the header eliminated entirely. This would allow for different fluids and/or wicking in the individual heat pipes if this is optimum for the application.

Figure 11:
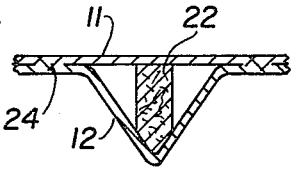
FIG. 11 shows an alternative to sectional view of FIG. 6.
Figure 12:
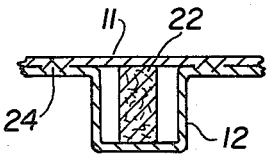
FIG. 12 is another alternative to the section of FIG. 6.

In other modifications, the top plate 11 can be simply a flat plate as shown in FIGS. 11 and 12 with, of course, the capillary grooves 23*a* in the regions above the furrows of plate 12. The shape of the furrow itself is of little consequence and can be arcuate as in FIG. 7, triangular as in FIG. 11, rectangular as in FIG. 12 and so on. Furthermore the plates 11 and 12 can be bonded with adhesives rather than by welding in those instances where the operating environment permits it.

I claim:

1. A heat exchanger assembly comprising a housing having a plurality of interior panel support members within a substantially open internal construction and, a plurality of flat sheet heat transfer units mounted on said support members, each of said units including a pair of flat sheets wherein at least one of said sheets includes a plurality of spaced parallel furrows, an integral manifolding channel in fluid communication with said furrows and a common fluid charging port connecting to said manifolding channel, said furrows being sealed off from said manifolding channel after charging to form a plurality of independently operative heat pipes.

2. An assembly as defined in claim 1 wherein said heat transfer units are juxtapositioned in a spaced parallel manner within said assembly as to allow fluid passage between the exterior surfaces of adjacent units.

3. A high temperature heat exchanger assembly comprising a housing having a plurality of interior panel support members within a substantially open internal construction and, a plurality of high temperature continuously operating heat transfer units mounted on said support members, each of said units including a pair of corrugated hastelloy sheets coupled together to form fluid channels therebetween, said sheets further including integral internal manifolding means for charging said channels with a working fluid suitable for high temperature operation, said channels being sealed off from said manifolding means after charging to form a plurality of independently operative heat pipes.

4. The assembly as defined in claim 3 wherein said channels are charged with sodium.

* * * * *